US005934082A

United States Patent [19]

Steinmeyer

[11] Patent Number: 5,934,082

[45] Date of Patent: Aug. 10, 1999

[54] INDIRECT COOLING SYSTEM FOR AN ELECTRICAL DEVICE

[75] Inventor: Florian Steinmeyer, Herzogenaurach, Germany

[73] Assignee: Siemens Aktiengesellschaft, München, Germany

[21] Appl. No.: 09/043,246

[22] PCT Filed: Aug. 29, 1996

[86] PCT No.: PCT/DE96/01606

§ 371 Date: Mar. 4, 1998

§ 102(e) Date: Mar. 4, 1998

[87] PCT Pub. No.: WO97/10469

PCT Pub. Date: Mar. 20, 1997

[30] Foreign Application Priority Data

Sep. 11, 1995 [DE] Germany ..... 195 33 555

[51] Int. Cl.[6] ..... F25B 19/00

[52] U.S. Cl. ..... 62/51.1; 62/259.2

[58] Field of Search ..... 62/51.1, 259.2

[56] References Cited

U.S. PATENT DOCUMENTS

| | | | |
|---|---|---|---|
| 4,689,970 | 9/1987 | Ohguma et al. | 62/51.1 |
| 4,777,807 | 10/1988 | White | 62/51.1 |
| 5,018,359 | 5/1991 | Horikawa et al. | 62/51.1 |
| 5,092,130 | 3/1992 | Nagao et al. | 62/6 |
| 5,129,232 | 7/1992 | Minas et al. | 62/51.1 |
| 5,176,003 | 1/1993 | Horikawa et al. | 62/51.1 |
| 5,235,818 | 8/1993 | Horikawa et al. | 62/51.1 |
| 5,530,413 | 6/1996 | Minas et al. | 62/51.1 |
| 5,551,243 | 9/1996 | Palkovich et al. | 62/51.1 |

FOREIGN PATENT DOCUMENTS

| | | |
|---|---|---|
| 0 250 685 | 1/1988 | European Pat. Off. . |
| 0 260 036 | 3/1988 | European Pat. Off. . |
| 0 350 266 | 1/1990 | European Pat. Off. . |
| 0 359 262 | 3/1990 | European Pat. Off. . |
| 0 392 771 | 10/1990 | European Pat. Off. . |
| 0 441 443 | 2/1991 | European Pat. Off. . |
| 1585049 | 1/1970 | France . |
| 37 43 033 | 6/1989 | Germany . |
| 40 20 593 | 1/1991 | Germany . |
| 43 25 727 | 2/1994 | Germany . |
| 4-106373 | 4/1992 | Japan . |
| 4278145 | 10/1992 | Japan . |

*Primary Examiner*—Ronald Capossela
*Attorney, Agent, or Firm*—Kenyon & Kenyon

[57] ABSTRACT

A cooling system for indirect cooling of a device, in particular a superconducting device, located in a vacuum chamber includes at least one refrigerating machine component. This refrigerating machine component includes an ambient temperature section and a low-temperature section, projects into the vacuum housing, is secured thereto via spring elements and, at its low-temperature end, is heat conductively connected to the device to be cooled. To reduce the vibrations transmitted to the device, the ambient temperature section of the refrigerating machine component may be arranged in the evacuatable compartment of a housing unit rigidly connected to the vacuum chamber.

13 Claims, 3 Drawing Sheets

INDIRECT COOLING SYSTEM FOR AN ELECTRICAL DEVICE

FIELD OF THE INVENTION

The present invention relates to a system for indirectly cooling an electrical device. In particular, the present invention relates to a system for indirectly cooling a superconducting device, to be kept at a low temperature, which is located in an evacuatable internal compartment of a vacuum chamber.

BACKGROUND INFORMATION

Electrical devices, in particular, superconducting devices to be cooled to low temperatures, such as the winding of a magnetic coil or a generator, or a superconducting cable, require cooling systems ensuring the operability of the components to be cooled at the low operating temperature. Bath cooling, forced cooling or, in particular, indirect cooling can be used to cool these components.

Indirect cooling allows relatively compact, coolant-free cryostats to be built without coolant containers and frees the user from having to replenish the cryofluid. The required cooling effect can be achieved using a cryocooler, normally designed as a dual-stage cooler, which often works by the Gifford-McMahon principle. With such a cryocooler, the first stage may have a typical cooling capacity of 50 W at approximately 60K in the first stage and 1 W at 10K in the second stage.

Indirect cooling can be advantageously provided for superconducting magnet systems used for nuclear spin tomography. The corresponding cooling system must be designed so that as little as vibration as possible is transmitted to the magnet system when the refrigerating machine or a refrigerating machine component is thermally coupled to the superconducting magnet system. All conventional refrigerating machines have mechanically movable components causing considerable vibrations in the frequency range of 1 to a few tens of Hz. The pressure fluctuations of the working medium, typically helium at approximately 20 bar, can also contribute to the vibrations. If these vibrations act on the magnet system without being damped, undesirable eddy currents appear as the magnet system generating a basic magnetic field with an induction of 1 T, for example, is operated. These eddy currents not only increase the heat load on the refrigerating system, but also interfere with the imaging system of the nuclear spin tomography machine.

In order to solve the problems concerning transmission of vibrations, in a refrigerating system described in European Patent Application No. 0 260 036 for the He-cooled superconducting magnet of a nuclear spin tomography system, the magnet and a surrounding radiation shield are coupled to components of a refrigerating machine via flexible connecting elements made of a heat-conducting material. The damping characteristic requirements of such a coupling, also acting mechanically between a magnet and a refrigerating machine, are however, in general, considerably higher in the case of magnets for nuclear spin tomography.

U.S. Pat. No. 5,129,232 also describes a cooling system for the superconducting magnet of a nuclear spin tomography system with appropriate vibration-damping heat-conducting connecting elements between a refrigerating machine and a radiation shield/superconducting material. To further improve the vibration damping, the refrigerating machine is supported by the vacuum chamber that surrounds the superconducting winding via spring elements. These spring elements not only have to bear the weight of the refrigerating machine itself, but also the force of the external atmospheric pressure acting upon the ambient temperature section of the refrigerating machine. This pressure force is caused because the ambient temperature section is under the normal pressure surrounding the vacuum chamber of the superconducting winding, while the low-temperature section of the refrigerating machine is in an evacuated housing unit, which projects into the vacuum chamber of the superconducting magnet. Therefore, the spring elements are pressed together with a relatively great force and therefore must have a matching elastic force. The rigidity of the springs is, therefore, also high, so that vibration damping by the conventional spring elements is limited accordingly.

SUMMARY OF THE INVENTION

In accordance with the present invention, a system for indirect cooling of an electrical device is provided. In particular, a superconducting device, to be kept at low temperature, is located in an evacuatable internal compartment of a vacuum chamber. The system contains at least one refrigerating machine component, which has an ambient temperature machine section and a low temperature machine section located in an evacuatable compartment. The refrigerating machine component movably projects into the vacuum changer through an opening in the vacuum chamber. The refrigerating component is also elastically secured to the vacuum chamber through a spring element so that it seals the vacuum chamber opening. Additionally, the refrigerating machine component is heat conductively connected at its low-temperature end to the electrical device.

An object of the present invention is to improve the cooling system so that the transmission of vibrations from the corresponding refrigerating machine or refrigerating machine components to the electrical device to be cooled is further reduced.

This object is achieved according to the present invention by the positioning that the ambient temperature section of the refrigerating machine component in an evacuatable compartment of a housing unit rigidly secured to the vacuum chamber.

One advantage of this design of the cooling system is that, by evacuating the ambient temperature section of the compartment surrounding the refrigerating machine, the force of the external pressure no longer acts upon the spring elements. The spring constant of the spring system made up of the spring elements can thus be reduced to a fraction of the value that would be required for vibration damping without evacuation. This results in a corresponding increase in vibration damping.

DETAILED DESCRIPTION OF THE INVENTION

Due to the vibration-damping support or suspension of the refrigerating machine or a machine component, the cooling system according to the present invention can be provided to particular advantage for electrical devices to be cooled to low temperatures that are sensitive to vibrations caused by refrigerating machine components. Such devices include, for example, the superconducting magnet system of a nuclear spin tomography machine. The cooling system can also be used with other electrical devices to be cooled to low temperatures.

Figure 1:
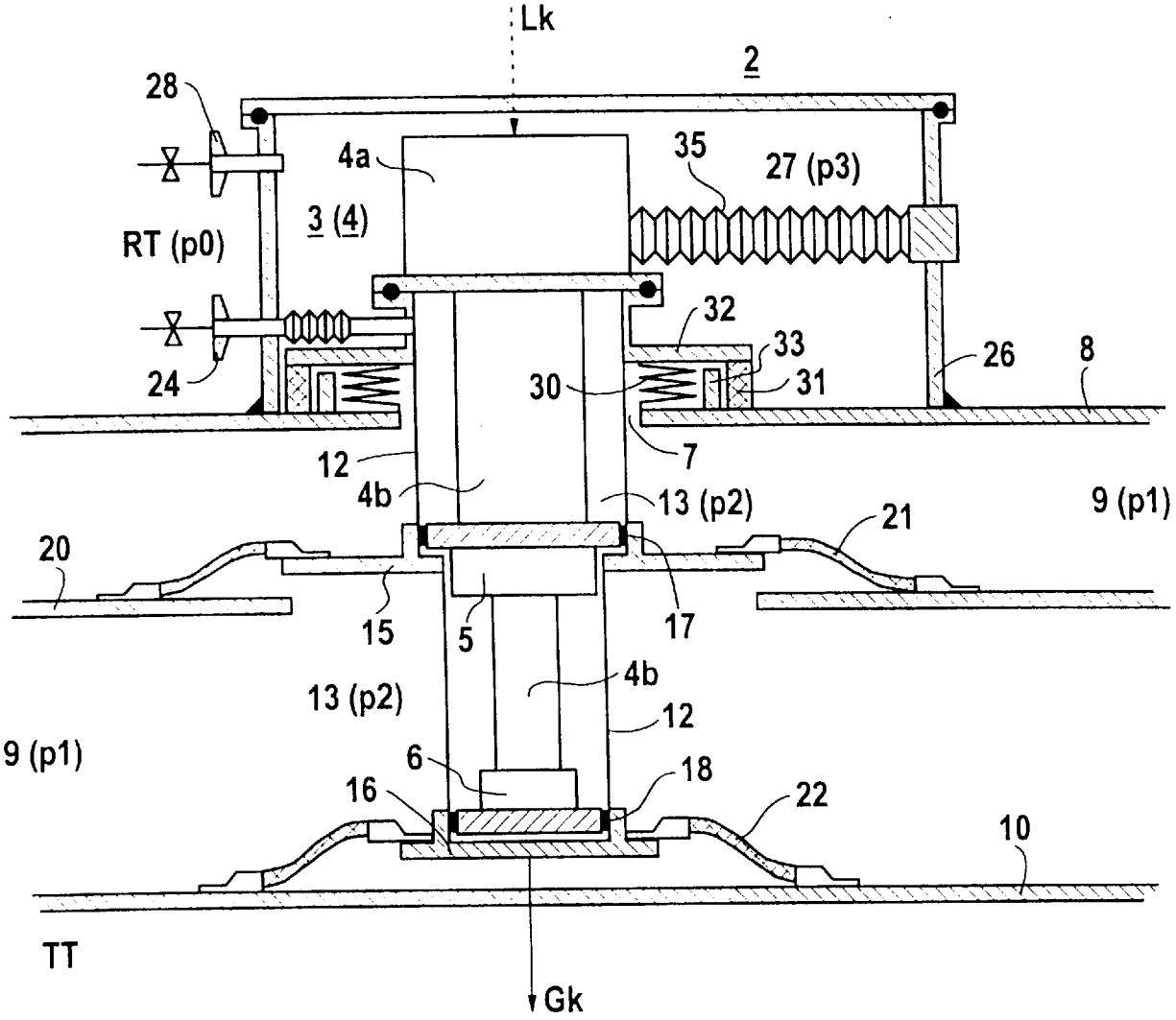
FIG. 1 shows a cooling system according to the present invention.

FIG. 1 shows a cross section of a component of a cooling system 2 designed according to present invention. The components not shown in FIG. 1 and not explained in detail in the following description are generally known in the art. The system allows a coolant-free cryostat to be designed.

The cooling system 2 shown in FIG. 1 includes at least one refrigerating machine 3 with at least one refrigerating machine component 4, which may have two cooling stages 5 and 6. Refrigerating machine 3 can be, for example, a Gifford-McMahon type cryocooler. Other single- or multi-stage refrigerating machine types can also be used. Refrigerating machine component 4 or the entire refrigerating machine comprises an ambient temperature section 4*a* located in the ambient temperature area RT, and a low-temperature section 4*b,* extending to the low-temperature area TT, and comprising cooling stages 5 and 6. Low-temperature section 4*b* projects into an evacuatable compartment 9 of vacuum chamber 8 through an opening 7 in the housing; vacuum chamber 8 is evacuated to a residual pressure p1 of an insulating vacuum. Opening 7 is dimensioned so that the low-temperature machine section 4*b* can move somewhat displaceably in its vertical direction. At the low-temperature end of second cooling stage 6, section 4*b* is heat-conductively coupled to a device 10 to be cooled, for example, a superconducting magnet. FIG. 1 only shows an upper portion of a structure to be cooled of this magnet, for example, its housing, surrounded by an insulating vacuum.

The low-temperature section 4*b* of refrigerating machine component 4 is preferably located in its own housing unit 12, whose internal compartment 13 can be evacuated. In order not to vent the entire vacuum system of vacuum chamber 8 to normal pressure p0 of the surrounding of cooling system 2, thus making it necessary to warm up and cool down magnet 10 to be cooled to a low temperature in a time-consuming procedure taking one week, for example, low-temperature section 4*b* of refrigerating machine component 4 may be installed in a separate vacuum-tight lock insulated against interior compartment 9 of vacuum chamber 8. This lock, which may contain thin-walled VA tubes and whose volume is not much greater than that of refrigerating machine section 4*b* needs to be, allows access to internal compartment 13 from the outside or the top. In the area of the position of the first and second cooling stages 5 and 6, heat-conducting connecting pieces 15 and 16 are provided on the outside of housing unit 12 and mechanically detachable heat contacts 17 and 18 are provided on the inside. These heat contacts can be formed with elastic contact plates made of Cu, which may be gold- or silver-plated and/or indium-plated. They allow heat transfer from the respective cooling stage of low-temperature section 4*b* of refrigerating machine component 4 to the thermal connecting pieces 15, 16 through the wall of housing unit 12. In the exemplary illustrated in FIG. 1, such a switchable heat contact is implemented in the radial direction. Such a heat contact is to be provided from the first and second cooling stages 5, 6 to a radiation shield 20 and the structure of magnets 10 via heat contacts 17, 18, thermal connecting pieces 15, 16, and flexible thermal connecting elements 21, 22. The flexible thermal connecting elements can be copper cords or strips, through which hardly any vibration of refrigerating machine component 4 is transmitted. In operation, housing unit 12, working as a lock, is evacuated to a residual pressure p2. It can be vented or evacuated for replacing refrigerating machine component 4 at inlet 24 of the low-temperature housing unit 12.

Refrigerating machine embodiments where the low-temperature section 4*b* is not arranged in its own evacuatable compartment 13 of a special housing unit, but projects directly into the inner space 9 of vacuum chamber 8, are also conceivable. In any case, opening 7 and the evacuatable space 13 that may be present are sealed in a vacuum-tight manner by the support or suspension of refrigerating machine component 4.

In order not to expose the ambient temperature section 4*a* of refrigerating machine component 4 and, thus, the support or suspension of this component to the external atmospheric pressure, ambient temperature section 4*a* is arranged in a separate evacuatable housing unit 26 according to the present invention. This housing unit encloses the ambient temperature section 4*a* of refrigerating machine component 4 and is rigidly and hermetically secured to the outside of vacuum chamber 8. Its compartment 27 can therefore be evacuated to a residual pressure p3 or vented separately from the insulating vacuum of magnet 10 and of the low-temperature machine section 4*b* through an inlet 28. When vented, refrigerating machine component 4 presses against vacuum chamber 8 not only with its own weight Gk of approximately 200 N, for example, but also with force Lk of the external atmospheric pressure. This means that for a diameter of approximately 160 mm of refrigerating machine component 4, an additional force Lk of approximately 2 kN, i.e., about 10 times the force of gravity Gk, appears. This force Lk is absorbed in conventional cooling systems (see U.S. Pat. No. 5,129,232) by a suitably rigid spring system, which should dampen the transmission of vibrations of the refrigerating machine component to the device 10 to be cooled. In the cooling system 2 according to the present invention, it is advantageous if the spring system is designed so that practically only the force of gravity Gk of refrigerating machine component 4 is absorbed. For this purpose, the spring support illustrated of the refrigerating machine component comprises spring elements 30, parallel to which elastic dampening elements 31 may be arranged. Elements 30 and 31 are mounted between vacuum chamber 8 and support extensions 32 that extend parallel thereto and are rigidly secured to refrigerating machine component 4, in particular to the area of connection between ambient temperature section 4*a* and low-temperature section 4*b*. Support extensions 32 and elements 30, 31 not only serve for support or suspension, as the case may be, but also for sealing interior space 9 of vacuum chamber 8 in the area of opening 7.

When housing unit 26 is vented, the support of refrigerating machine component 4 elastically vibrates, due to the effect of vacuum on its low-temperature section, up to a fixed mechanical stop 33. The vibration is only damped when the compartment 27 of housing unit 26 is evacuated to an operating pressure p3, of less than 100 mbar, for example. The typical pressure is approximately 10 mbar. Force Lk of the atmospheric pressure is reduced to approximately 20 N due to the evacuation. In this state, refrigerating machine component 4 is elastically supported by elements 30, 31. The corresponding spring constant can therefore be reduced by a factor of 1/10 compared to the value that would be required for vibration damping without evacuation. The resulting soft suspension allows, in many applications, refrigerating machine component 4 to be mounted directly on a housing component of a device to be cooled to a low temperature, such as a magnet, without additional mechanical and heat-conducting elements being required. The FIG. 1 indicates flexible connecting pipes 35 for the ambient temperature section 4*a* of the refrigerating machine, extending in a vacuum-tight manner through compartment 27 of the ambient temperature housing unit 26, for example, for helium and electrical connecting cables.

Figure 2:
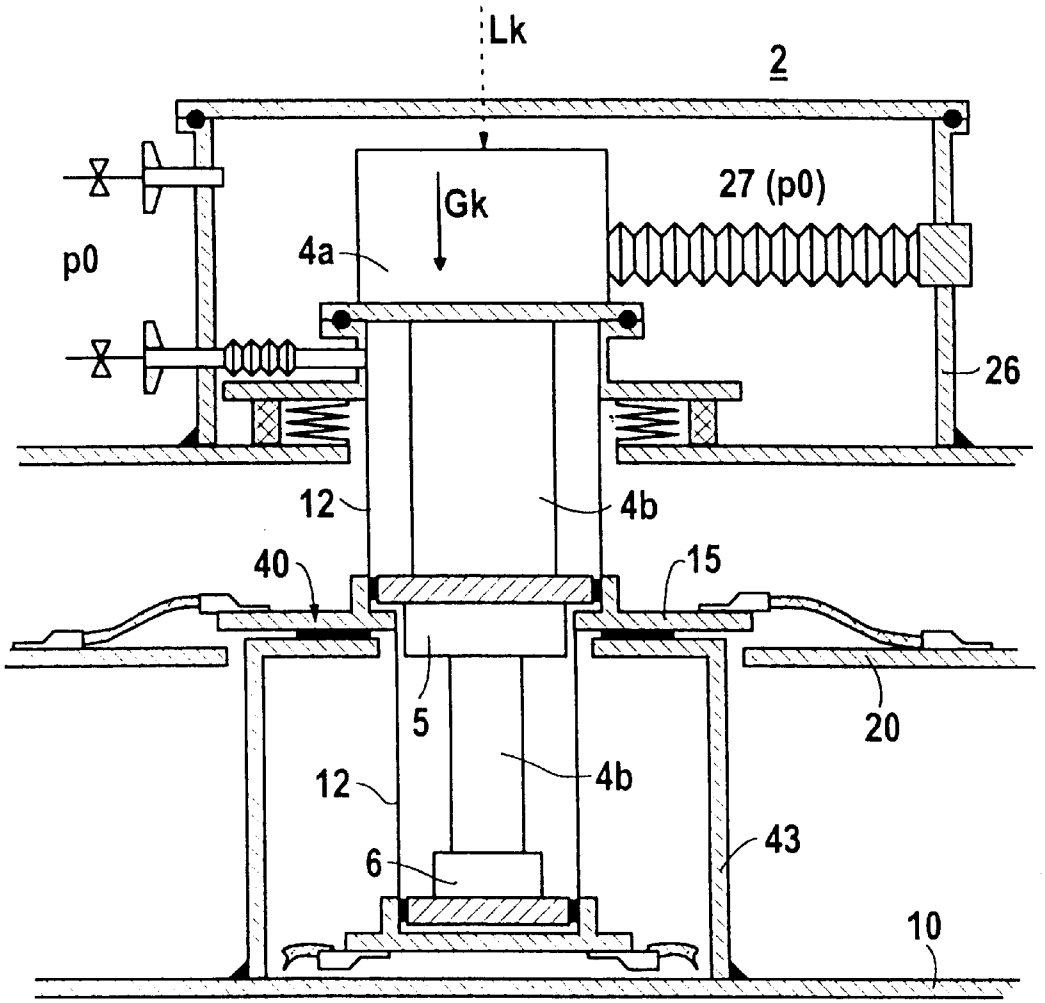
FIG. 2 shows the cooling system with an open heat switch.
Figure 3:
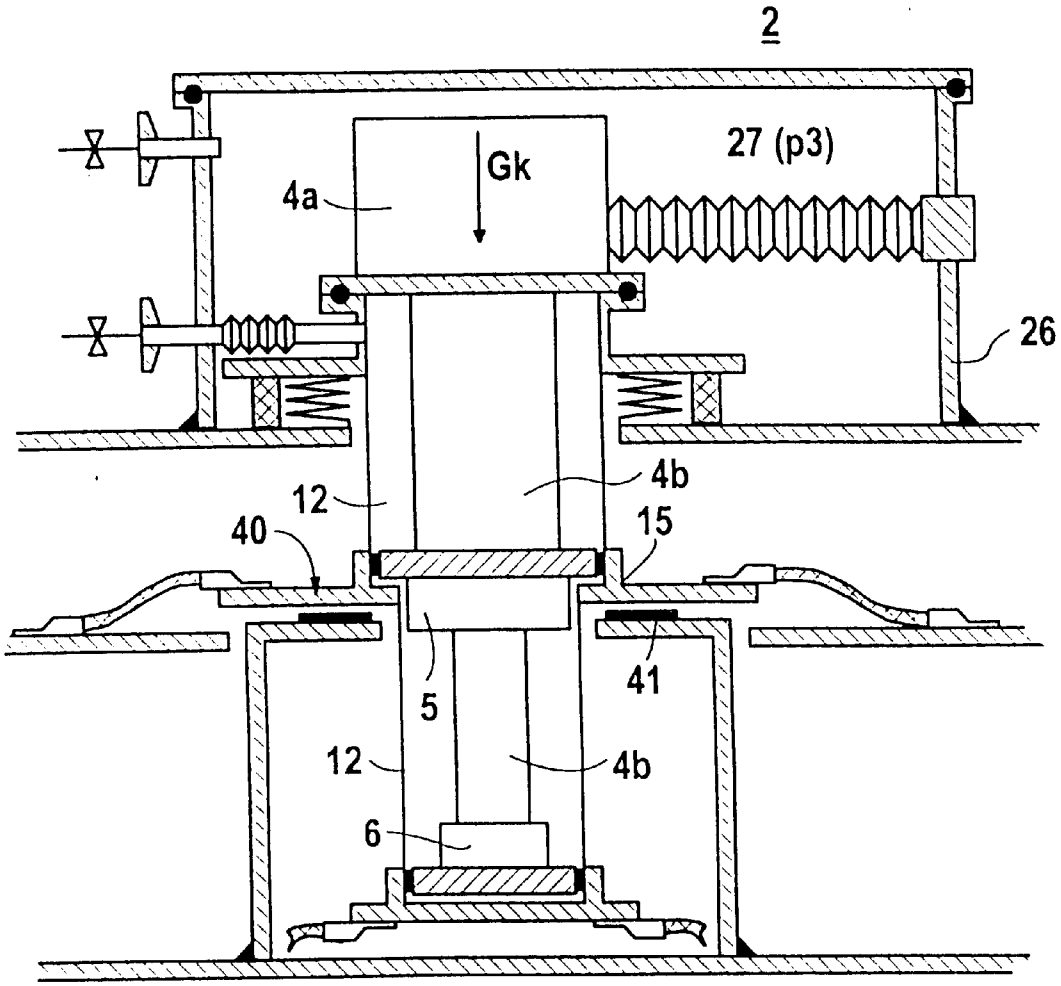
FIG. 3 shows the cooling system with a closed heat switch.

In a conventional Gifford-McMahon refrigerating machine 3, the refrigerating capacity of second stage 6 of refrigerating machine component 4, to which the device to be cooled, for example, magnet 10, is thermally coupled, is approximately 1/5 of the refrigerating capacity of first stage 5. The heat capacity of a superconducting magnet, contributes at least 2/3 to the thermal mass to be cooled in a typical design. To cool a superconducting magnet from ambient temperature to operating temperature with the help of a refrigerating machine alone, it is therefore advantageous to use the relatively high refrigerating capacity of the first stage 5 of the refrigerating machine to precool the magnet. This requires a detachable thermal contact, which first establishes a thermally conductive connection between the first cooling stage and the magnet for cooling and is only opened at a temperature level close to the final temperature of the first stage. The magnet then reaches its operating temperature with the refrigerating capacity of the second stage. Have a very low heat conductivity is required when the thermal contact is open, since a heat flow leak through this contact would represent a load on the second stage. An exemplary embodiment of a similar detachable heat contact is shown in FIGS. 2 and 3, FIG. 2 showing the contact closed and FIG. 3 shows the contact open. The heat contact shown in FIGS. 2 and 3 and denoted as 40 is formed by a thermally conductive contact plate 41, located between a supporting structure 43 rigidly connected to device 10 to be cooled and a component of the low-temperature section 4*b* of the refrigerating machine, kept at least largely at the temperature of the first cooling stage. This component of refrigerating machine section 4*b* can be formed by thermal connecting piece 15, for example. Since this connecting piece is rigidly connected to refrigerating machine section 4*b* or housing unit 12 that surrounds it, it follows the excursion of spring elements 30, 31. During cooling from ambient temperature, compartment 27 of external housing unit 26 is first vented. Due to pressure conditions p0, refrigerating machine component 4 is pressed by the external atmospheric pressure against the soft support via spring elements 30, 31 in the direction of magnet 10 with force Lk, until thermal contact 40 of the first cooling stage 5 reaches its mechanical stop (see FIG. 2). This stop is formed by contact plates 41 on support structure 43, rigidly connected to magnet 10. Due to the evacuation of compartment 27 to pressure p3 after the magnet has been precooled approximately to the temperature of first cooling stage 5, force Lk no longer acts on refrigerating machine component 4, so that spring elements 30, 31 elongate with the remaining force of gravity Gk. Connecting piece 15, rigidly connected to refrigerating machine component 4, is lifted from plates 41 to a degree corresponding to this displacement, so that thermal contact 40 is opened.

When thermal contact is open (see FIG. 3), full isolation of device 10 to be cooled and the support structure 43 connected to it from the first cooling stage 5 of refrigerating machine section 4*b*, is guaranteed so that no thermal load is placed on second cooling stage 6 of this section by heat leaks from the warmer first stage. Compared with the conventional gas heat switches, this arrangement can be relatively compact, yet allows good thermal conductivity.

FIGS. 1 through 3 show a support according to the present invention of a refrigerating machine or a component thereof. A suspension using spring elements that are not to be affected by force Lk of the atmospheric pressure acting upon the machine section at ambient temperature is also conceivable.

What is claimed is:

1. A system for indirectly cooling an electrical device in a vacuum chamber, the vacuum chamber including a first evacuatable compartment, the electrical device positioned in the first evacuatable compartment, the vacuum chamber further having an opening, comprising:

at least one refrigerating machine component including an ambient temperature machine section and a low-temperature machine section, and having a low-temperature end, the low-temperature machine section positioned in the first evacuatable compartment, the at least one refrigerating machine component movably projecting into the vacuum chamber through the opening, the at least one refrigerating machine component being elastically secured to the vacuum chamber via at least one spring element and hermetically sealing the opening of the vacuum chamber, the low-temperature end of the at least one refrigerating machine component being heat conductively coupled to the electrical device; and a housing unit coupled to the vacuum chamber, the housing unit having a second evacuatable compartment, the ambient temperature machine section being arranged in the second evacuatable compartment.

2. The system according to claim 1, wherein the electrical device is a superconducting device.

3. The system according to claim 1, wherein the first evacuatable compartment surrounds the low-temperature machine section.

4. The system according to claim 1, wherein the second evacuatable compartment surrounds the low-temperature machine section and projects into the first evacuatable compartment, the second evacuatable compartment being vacuum-tight isolated from the first evacuatable compartment, and wherein the housing unit is a lock accessible from the second evacuatable compartment.

5. The system according to claim 4, further comprising:

at least one cooling stage thermally connected to at least one component of the housing unit using at least one detachable heat contact.

6. The system according to claim 1, wherein the at least one spring element supports the at least one refrigerating machine component.

7. The system according to claim 1, wherein the at least one spring element suspends the at least one refrigerating machine component.

8. The system according to claim 1, further comprising:

at least one elastic damping element positioned parallel to the at least one spring element.

9. The system according to claim 8, wherein at least one of i) the at least one spring element, and ii) the at least one elastic damping element, seal the opening of the vacuum chamber to the at least one refrigerating machine component.

10. The system according to claim 1, wherein the low-temperature machine section includes at least two cooling stages.

11. The system according to claim 1, further comprising:

a stop element limiting the excursion of the at least one spring element when the second evacuatable compartment is vented.

12. The system according to claim 11, wherein the stop element is a thermal contact establishing a heat conducting connection between a first cooling stage and the electrical device only when the second evacuatable compartment is vented.

13. The system according to claim 1, further comprising:

at least one elastic connecting element thermally coupling the low-temperature end of the at least one refrigerating machine component to the electrical device.

* * * * *